US010611616B2

(12) United States Patent
Miles et al.

(10) Patent No.: US 10,611,616 B2
(45) Date of Patent: Apr. 7, 2020

(54) AERIAL DEVICE WITH QUICK-COUPLING IMPLEMENT

(71) Applicant: Altec Industries, Inc., Birmingham, AL (US)

(72) Inventors: Johnson X. Miles, Roanoke, VA (US); Gregory M. Stakor, Vinton, VA (US)

(73) Assignee: Altec Industries, Inc., Birmingham, AL (US)

( * ) Notice: Subject to any disclaimer, the term of this patent is extended or adjusted under 35 U.S.C. 154(b) by 279 days.

(21) Appl. No.: 14/564,381

(22) Filed: Dec. 9, 2014

(65) Prior Publication Data

US 2016/0161046 A1 Jun. 9, 2016

(51) Int. Cl.
*B66F 11/04* (2006.01)

(52) U.S. Cl.
CPC ..... *B66F 11/044* (2013.01); *B66F 11/046* (2013.01)

(58) Field of Classification Search
CPC .... B66F 11/044; B66F 11/046; B66F 17/006; E06C 5/04; E01D 19/106; E04G 5/14; E04G 3/30
See application file for complete search history.

(56) References Cited

U.S. PATENT DOCUMENTS

RE23,466 E * 3/1952 McElhinney et al. ... A01C 3/04 414/718
3,295,633 A * 1/1967 Milner, Jr. ..... B66F 11/044 182/222
4,070,807 A * 1/1978 Smith, Jr. ..... E02F 3/3402 182/127
4,188,757 A * 2/1980 Smith, Jr. ..... B66F 9/0655 182/2.11
4,466,506 A * 8/1984 Dolenti ..... H02G 1/02 182/2.1
4,480,955 A * 11/1984 Andrews ..... E02F 3/3622 37/403
4,518,059 A * 5/1985 Frey-Wigger ..... B66F 11/046 182/2.7

(Continued)

FOREIGN PATENT DOCUMENTS

EP 2433898 A1 * 3/2012 ..... B66F 11/046
FR 3000200 A1 * 6/2014 ..... G01G 21/23
FR 3000200 A1 * 6/2014 ..... B66F 17/006

OTHER PUBLICATIONS

For the American Heritage Dictionary definition:recess. (n.d.) American Heritage® Dictionary of the English Language, Fifth Edition. (2011). Retrieved May 1, 2018 from https://www.thefreedictionary.com/recess (Year: 2018).*

*Primary Examiner* — Colleen M Chavchavadze
*Assistant Examiner* — Candace L Bradford
(74) *Attorney, Agent, or Firm* — Erise IP, P.A.

(57) ABSTRACT

A quick coupling implement for an aerial device has a base, a boom assembly, the implement, and an adapter. The adapter is emplaced on a portion of the boom assembly to allow for quickly coupling the implement. The adapter comprises a boom-raise-interfacing segment with at least one opening for securing to the boom raise of the boom assembly via a retaining pin. The adapter also comprises an implement-interfacing segment that presents a complementary shape to an adapter-receptor segment of the implement. The implement may be a utility platform for supporting a utility worker.

8 Claims, 10 Drawing Sheets

(56) References Cited

U.S. PATENT DOCUMENTS 4,754,840 A * 7/1988 MacDonald ..... B66F 11/044 182/2.3
4,763,755 A * 8/1988 Murray ..... B66F 11/044 182/2.2
4,784,278 A * 11/1988 Luscombe ..... B66F 11/044 182/2.11
4,838,381 A * 6/1989 Michaud ..... B66F 11/044 182/2.3
4,930,598 A * 6/1990 Murrill ..... B66F 11/042 182/141
5,271,707 A * 12/1993 Derksen ..... B66F 11/044 182/2.8
5,666,794 A * 9/1997 Vought ..... A01D 41/16 56/15.2
5,727,645 A * 3/1998 Woodling ..... B66F 11/046 182/2.1
5,944,138 A * 8/1999 Vollmer ..... B66F 11/044 182/2.1
6,088,939 A * 7/2000 Logan ..... E02F 3/404 37/404
6,499,934 B1 * 12/2002 Kaczmarski ..... E02F 3/3627 37/468
7,073,972 B1 * 7/2006 Schumacher ..... E02F 3/3627 403/382
7,984,575 B2 * 7/2011 Robl ..... E02F 3/3622 172/273
8,833,519 B1 * 9/2014 Glazer ..... B66F 11/046 182/2.1
9,162,861 B1 * 10/2015 Craig ..... B66F 17/006
2007/0272421 A1 * 11/2007 Elliott ..... A01B 59/064 172/445.1
2011/0088970 A1 * 4/2011 Beji ..... B66F 11/046 182/18
2012/0006767 A1 * 1/2012 Bennett ..... F16M 13/02 211/26
2013/0048425 A1 * 2/2013 Thompson ..... B66F 17/006 182/46
2014/0138183 A1 * 5/2014 Chard ..... B66F 17/006 182/46
2014/0317967 A1 * 10/2014 Parker ..... E02F 3/325 37/403
2016/0257543 A1 * 9/2016 Hufnagl ..... B66F 11/044

* cited by examiner

AERIAL DEVICE WITH QUICK-COUPLING IMPLEMENT

BACKGROUND

1. Field

Embodiments of the invention relate to aerial devices and their implements. More specifically, embodiments of the invention relate to an aerial device that is adapted to quickly couple to and decouple from an implement, such as a utility platform assembly, via an adapter.

2. Related Art

Utility workers utilize an aerial device to perform numerous tasks. For example, the aerial device may be equipped with a utility platform to reach an inaccessible location, equipped with an auger to drill a hole, or equipped with a winch or other tool to move a heavy object. Because the utility worker must perform numerous different tasks, it is occasionally necessary for the utility worker to change the implement. Also, the utility worker may remove the implement before traveling to or from a worksite, performing maintenance, etc.

Utility platforms and other implements of the prior art are difficult to couple to the aerial device. The utility worker couples the implement to a boom assembly by aligning two openings in a boom raise of the boom assembly with two openings in the implement. In order to do this, the utility platform must be substantially level and the boom assembly must be precisely positioned to obtain coaxial alignment of the openings of the respective boom raise and implement. This is difficult to achieve because the utility platform can be very heavy and because the boom assembly cannot make precise movements. The utility worker must then place a pin through the aligned openings in the implement and the boom raise. This is also difficult because the alignment must be precise for the pin to fit into the openings and because the utility worker is often using both hands to align the implement with the openings of the boom raise. Other implements, such as augers and winches for example, must be either lifted by the utility worker to the boom raise, or positioned on the ground such that the boom raise can effectively interface with the implement. Similarly, decoupling the implements of the prior art is difficult. In order to remove the pin, the implement must be positioned such that there is very little weight on the pin. Accordingly, an aerial device, a utility platform assembly, and a method for quickly coupling an implement to the aerial device are lacking in the prior art.

SUMMARY

Embodiments of the invention solve the above-mentioned problems by providing an adapter for quick coupling. The adapter is secured by a utility worker to a boom raise of an aerial device. The adapter can then quickly and easily couple to an implement, such as a utility platform assembly, an auger, a winch, etc. The precise alignment of the openings allows for easy use of the adapter, which is relatively lighter and easier to manipulate, instead of the implement itself. The adapter presents hook segments for ease of installation of one of the pins, as discussed below. The adapter, once installed, allows for quick and easy coupling of the implement without requiring precise alignment of the adapter and the implement. Moreover, the boom raise and the implement need not be level with each other. Alternatively stated, the adapter, when positioned on the boom raise, can interface with the platform at a plurality of angles, thus not requiring the precise positioning of the boom raise and implement of the prior art. The utility worker decouples the implement by operating at least one latch, which can be easily done by the utility worker even if there is weight on the pins because the pins do not have to be removed to decouple the implement.

A first embodiment of the invention is directed to an aerial device. The aerial device comprises a base, a boom assembly, an implement, and an adapter. The adapter is emplaced on a boom raise of the boom assembly to allow for quickly coupling the implement. The adapter comprises a boom-raise-interfacing segment with at least one opening for securing to the boom raise of the boom assembly via a retaining pin. The adapter also comprises an implement-interfacing segment that present a complementary shape to an adapter-receptor segment of the implement. A plurality of different types of implements may be included, each of which presents an adapter-receptor segment for quickly interfacing with the implement.

A second embodiment is directed to a utility platform assembly. The utility platform assembly comprises a utility platform, a yoke, and an adapter. The utility platform assembly is adapted for a utility worker to stand therein and perform work. The yoke keeps the utility platform level and adapts the utility platform to interface with adapter (being already installed on the boom raise of the boom assembly). The adapter provides a quick-coupling feature so as to minimize the time and hassle for the utility worker to install.

A third embodiment is directed to a method of coupling the utility platform assembly to the aerial device. The method comprises the following steps. The utility worker obtains the aerial device, the implement having the adapter-receptor segment, and the adapter. The utility worker then installs the adapter on the boom raise of the boom assembly of the aerial device, utilizing at least one retaining pin. The utility worker manipulates the boom assembly and/or the implement to align them and extends the boom assembly until a wedge protrusion of the adapter interfaces under a lip segment of the adapter-receptor segment of the implement. This is accomplished without precise movements and alignments of openings, as required in the prior art. The utility worker lifts the boom assembly until the boom assembly begins to lift the implement. Upon lifting the implement, a plate of the adapter-receptor segment and a plate of the adapter become substantially parallel and adjacent. At least one automatic latch then engages to secure the implement to the adapter. The utility worker may then additionally secure at least one manual latch to further secure the two devices together.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 1:
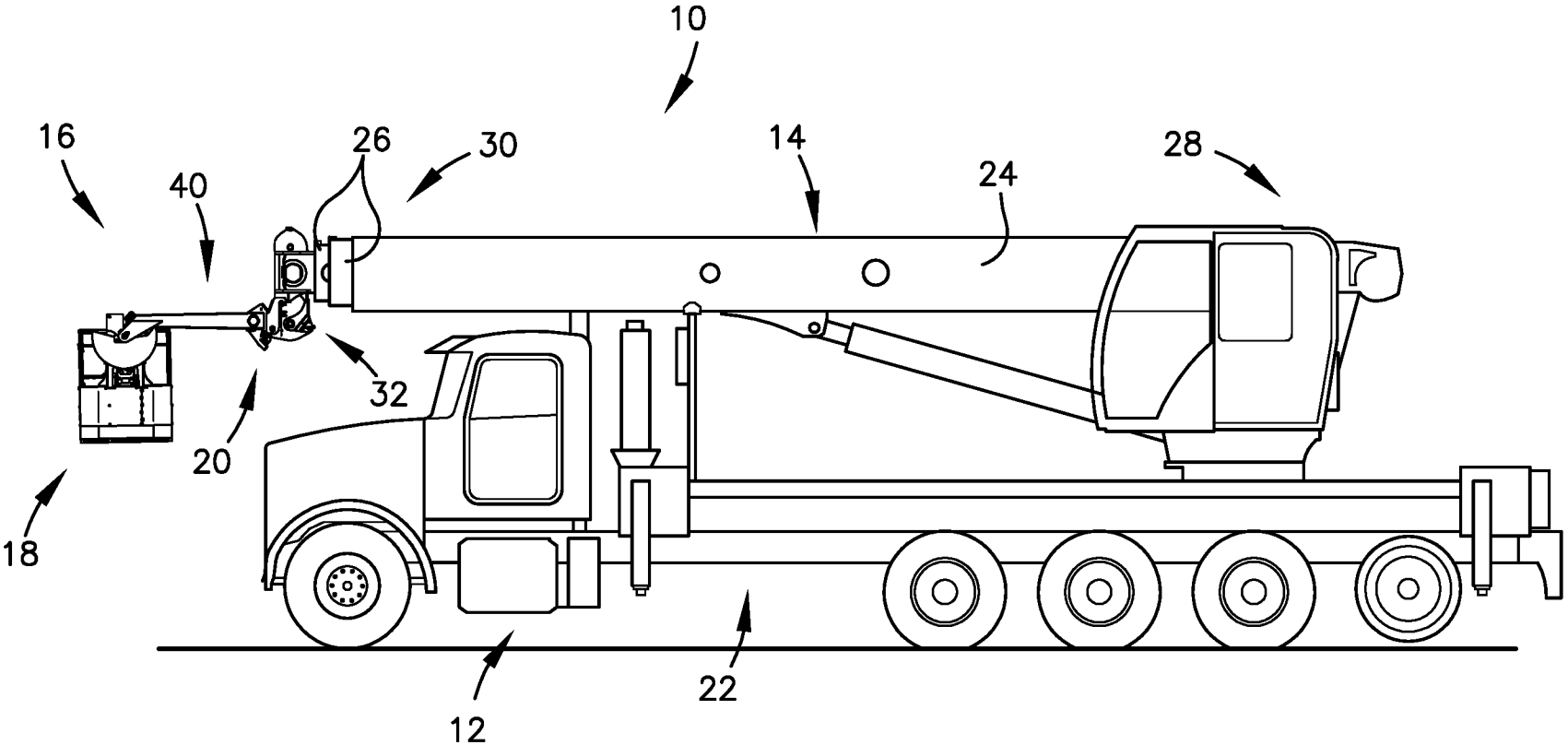
FIG. 1 is an environmental view of an aerial device with a boom assembly and a utility platform assembly.
Figure 2:
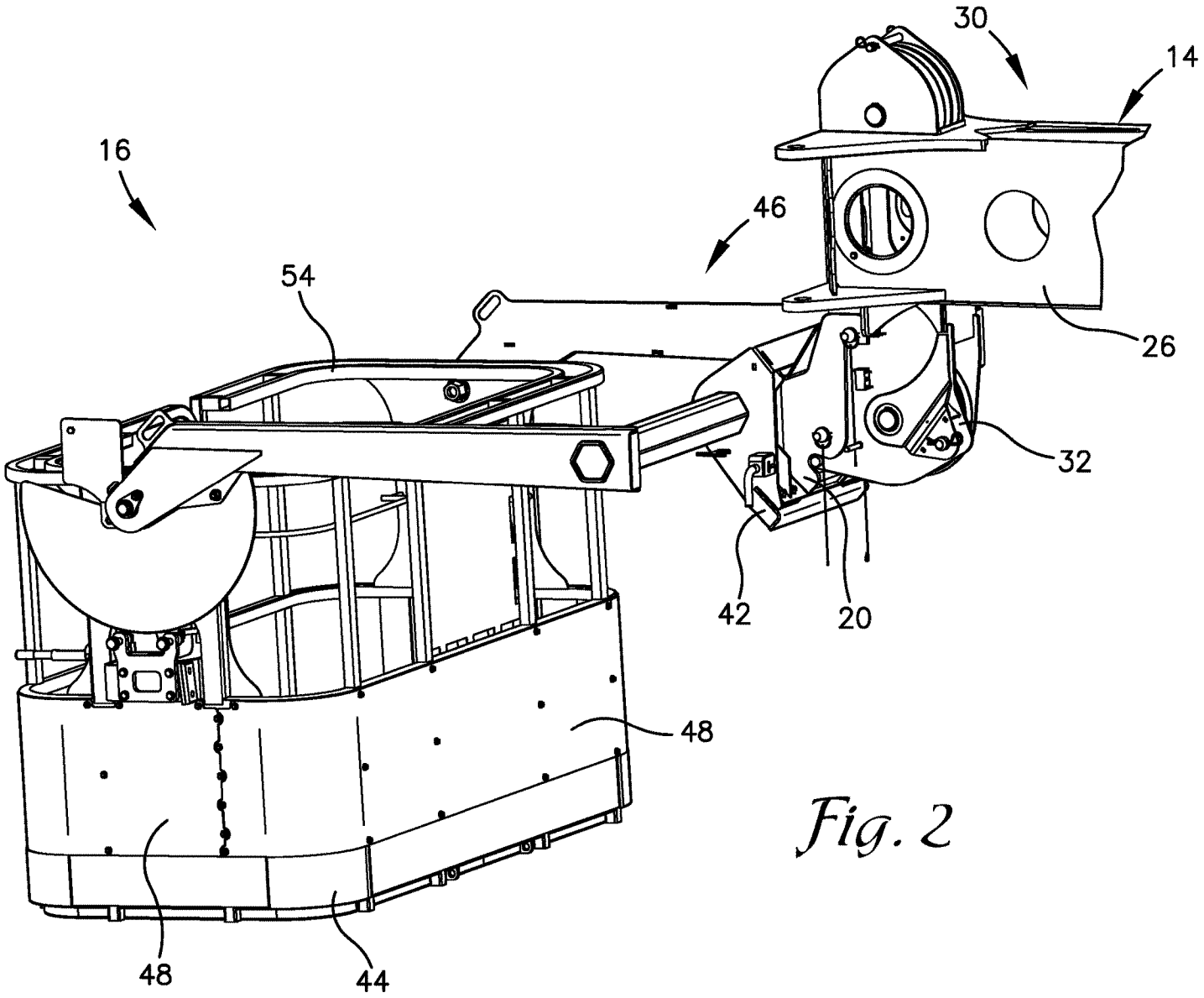
FIG. 2 is a perspective view of the boom assembly and utility platform assembly of FIG. 1.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

An aerial device 10, constructed in accordance with various embodiments of the invention, is shown in FIG. 1. The aerial device 10 generally comprises a base 12 with a boom assembly 14 rotatably mounted thereto. An implement 16, such as a utility platform assembly 18 or other implement for performing work, is disposed on the boom assembly 14 to facilitate the accomplishment of a task by a utility worker. The utility platform assembly 18 is secured to the boom assembly 14 via an adapter 20, as discussed below. The adapter 20 provides for quick and easy coupling of the utility platform assembly 18.

The base 12 of the aerial device 10 is a selectively stabilized platform. In embodiments of the invention, the base 12 is a utility truck 22 (as illustrated in FIG. 1), a crane base, an oil rig, an earth-working machine, or a fixed structure. The base 12 provides stability and a counterweight to a load being supported by the boom assembly 14. Larger loads typically require a more stable and a heavier base. To achieve this stability, in embodiments of the invention, the base 12 may utilize hydraulic stabilizers, outriggers, and/or sand bags.

The boom assembly 14 broadly comprises an outer boom section 24 and at least one inner boom section 26. The boom assembly 14 presents a proximal end 28 and a distal end 30. The proximal end 28 is rotatably and/or pivotably secured to a portion of the base 12. The distal end 30 is secured to the implement 16. The at least one inner boom section 26 is at least in part disposed within the outer boom section 24. The at least one inner boom section 26 telescopes to extend or retract into the outer boom section 24. In embodiments of the invention, the boom assembly 14 may comprise additional equipment including any of the following: power lines for the routing of hydraulic, pneumatic, or electrical power; communication wires for user-controls located on the boom assembly 14; or support cables (not illustrated). In some embodiments of the invention, the boom assembly 14 comprises a first boom section that rotatably secured to the base 12 and a second boom section rotatably secured to a distal end of the first boom section (not illustrated). In still other boom assemblies, a combination of the telescoping and pivoting boom sections is utilized.

The at least one inner boom section 26 may telescope into a plurality of positions with respect to the outer boom section 24, including a fully retracted position, in which the length of the body of the at least one inner boom section 26 is substantially inserted within the outer boom section 24, and a fully extended position, in which only a relatively small portion of the length of the body of the at least one inner boom section 26 is inserted within the outer boom section 24.

As best illustrated in FIGS. 2-3 and 5-6, a boom raise 32 is disposed at the distal end 30 of the boom assembly 14. The boom raise 32 is a segment or portion of the inner boom section 26 adapted to receive and securely hold the implement 16. Some embodiments of the boom raise 32 also pivot or rotate to as to assist the performance of the work. For example, the boom raise 32 may pivot to maintain a digger derrick vertical during the drilling of a hole in the ground. As another example, the boom raise 32 may pivot to ensure that the utility platform assembly 18 remains level with the ground. The movement of the boom raise 32 may be automatic, controlled by the utility worker, or both.

Figure 5:
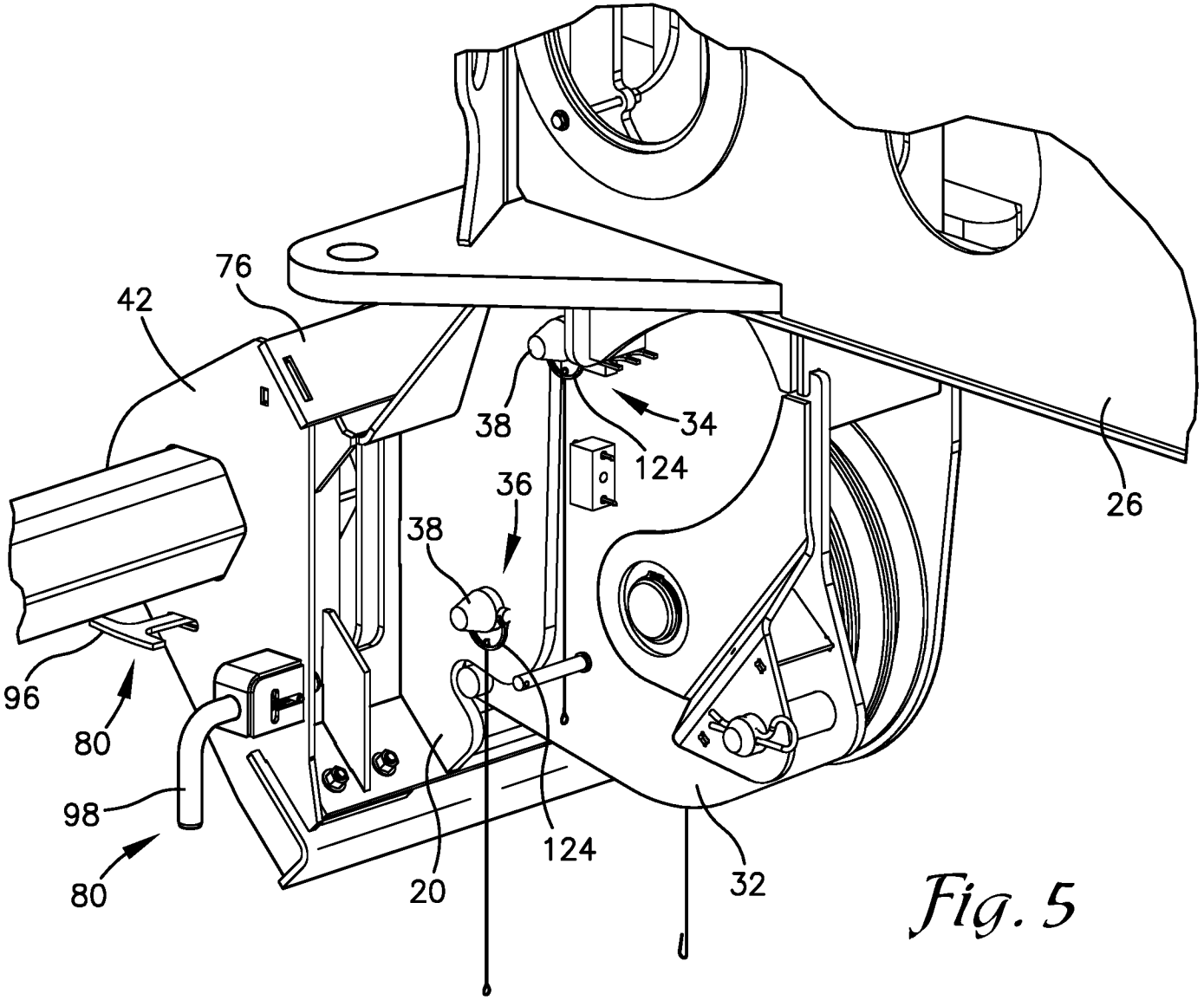
FIG. 5 is a perspective view illustrating how the utility platform assembly is secured to the boom assembly via the adapter, as viewed from a first end.
Figure 6:
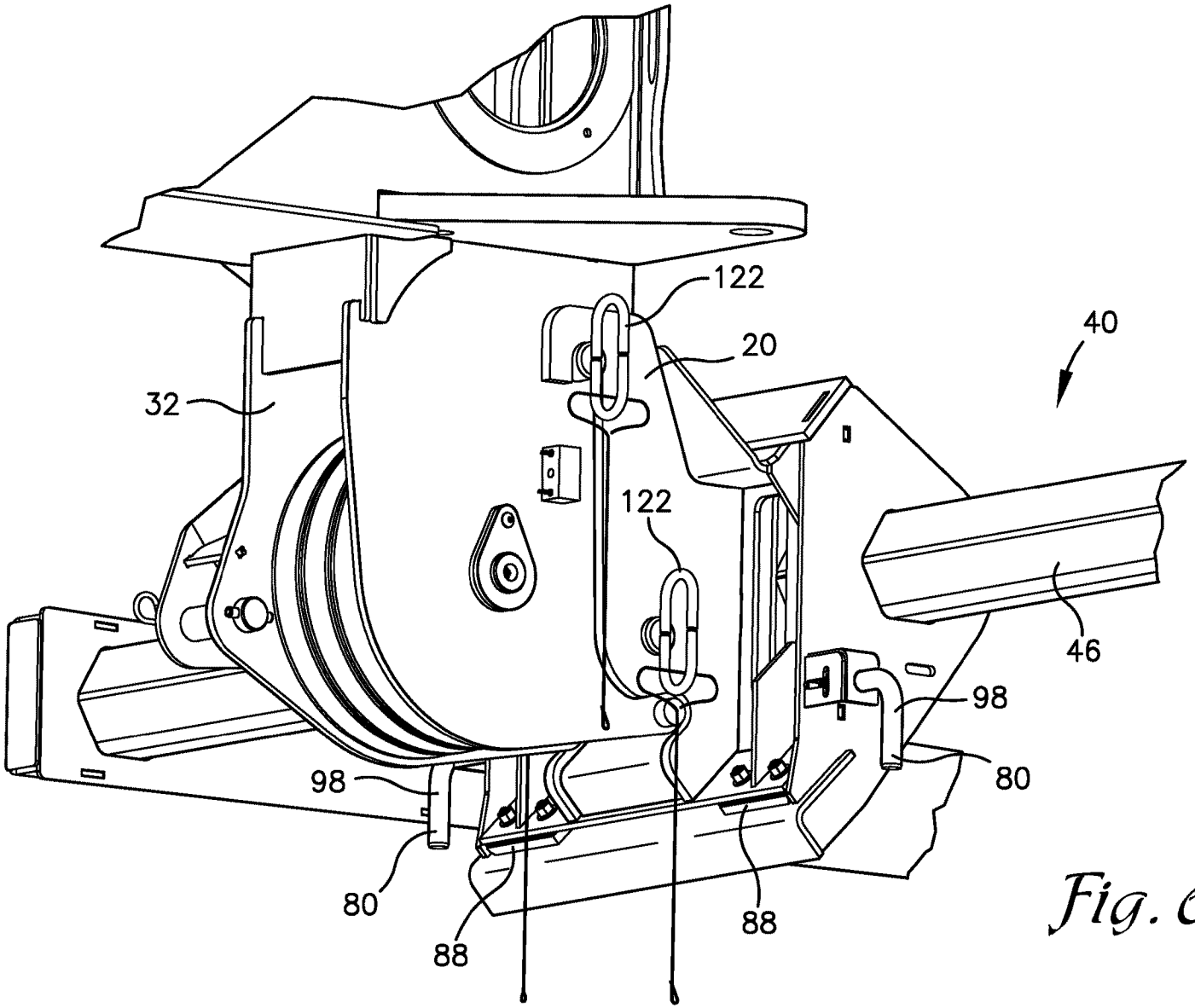
FIG. 6 is a perspective view of FIG. 5, as viewed from a second end.

Referring to FIG. 5, the boom raise 32 presents at least a first opening 34 and a second opening 36 for interfacing with the implement 16 and/or the adapter 20. Each opening 34, 36 is adapted to receive a retaining pin 38 through the opening and through a corresponding opening in the implement 16 or adapter 20, as discussed below. The adapter 20, as discussed below, is adapted to be secured to the boom raise 32 via the retaining pins 38. The adapter 20 presents a quick-coupling feature for quickly and easily securing the implement 16. The adapter 20 is therefore disposed between the boom raise 32 and the implement 16. Other implements may directly couple to the boom raise 32 without the adapter 20.

The aerial device 10 utilizes the implement 16 to perform tasks that could include, but are not limited to: raising and lowering one or more utility workers located inside the utility platform assembly 18; lifting a pallet of wood with a wench; drilling a hole for the emplacement of a pole or post with a digger derrick; or excavating material such as dirt with an earth-moving implement. The implement 16 could therefore be any attachment for accomplishing a task from the distal end 30 of the boom assembly 14, or any combination of attachments. It should be appreciated that while the implement 16 depicted in FIGS. 1-4 is a utility platform assembly 18, embodiments of the invention comprise other types of implements, such as those discussed herein or equivalents.

The implement 16 comprises a tool 40 and an adapter-receptor segment 42. The tool 40 assists the utility worker in performing at least one task. Examples of tools 40 include, but are not limited to, utility platforms (for single or multiple utility workers), augers, winches, jibs, digger derricks, testing equipment, forked arms, saws, wrecking balls, ladders, video cameras, photography cameras, etc. The adapter 20 receptor segment is coupled to the tool 40 and oriented outward, such that it can face towards adapter 20 and interface therewith.

Figure 3:
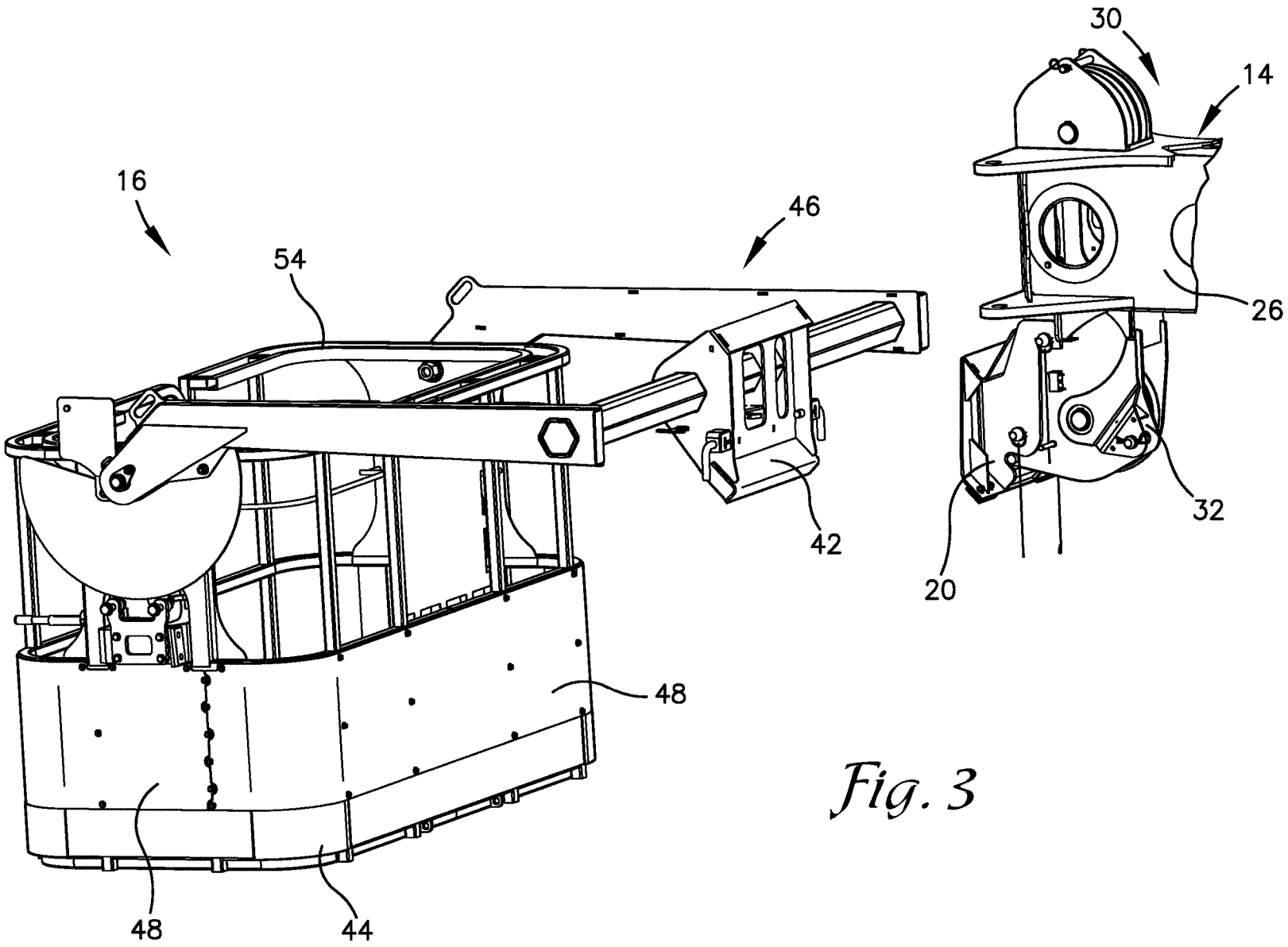
FIG. 3 is a perspective view of the boom assembly and utility platform assembly of FIG. 1, with the utility platform assembly being decoupled from an adapter.

As best illustrated in FIG. 3, the adapter-receptor segment 42 presents a complementary shape to the adapter 20, such that the adapter 20 (being coupled to the boom raise 32 of the boom assembly 14) can be placed into, around, or through the adapter-receptor segment 42 by a utility worker controlling the movement of the boom assembly 14. Upon being placed into, around, or through the adapter-receptor segment 42, the adapter 20 and the implement 16 automatically lock together (as discussed below).

Because the adapter 20 and the adapter-receptor segment 42 of the implement 16 present a complementary shape, they made be sold or manufactured for each other. For example, a quick-coupling platform may be sold such that the adapter 20 is sized and shaped to fit on a standard boom raise, and the utility platform assembly 18 is adapted to fit the adapter 20. As another example, a single adapter may be sold to fit a plurality of implements 16, each with the same complementary shape. This allows the benefits of the quick coupling to multiple implements 16 and prevents the utility worker form having to remove the implement 16 from the boom raise 32 to install another type of implement 16. The complementary shape of the adapter 20 and adapter-receptor segment 42 of an exemplary embodiment of the invention are discussed below.

In some embodiments of the invention, the implement 16 is a utility platform assembly 18, as illustrated in FIGS. 1-4. The utility platform assembly 18 comprises a utility platform 44 and a yoke 46, and may additionally comprise the adapter 20 itself (as discussed below). The utility platform 44 provides an elevated surface from which at least one utility worker can perform a task. The yoke 46 interfaces between utility platform 44 and the boom assembly 14. As such, the yoke 46 presents the adapter-receptor segment 42 for quickly coupling to the adapter 20 when mounted on the boom raise 32 of the boom assembly 14.

Figure 4:
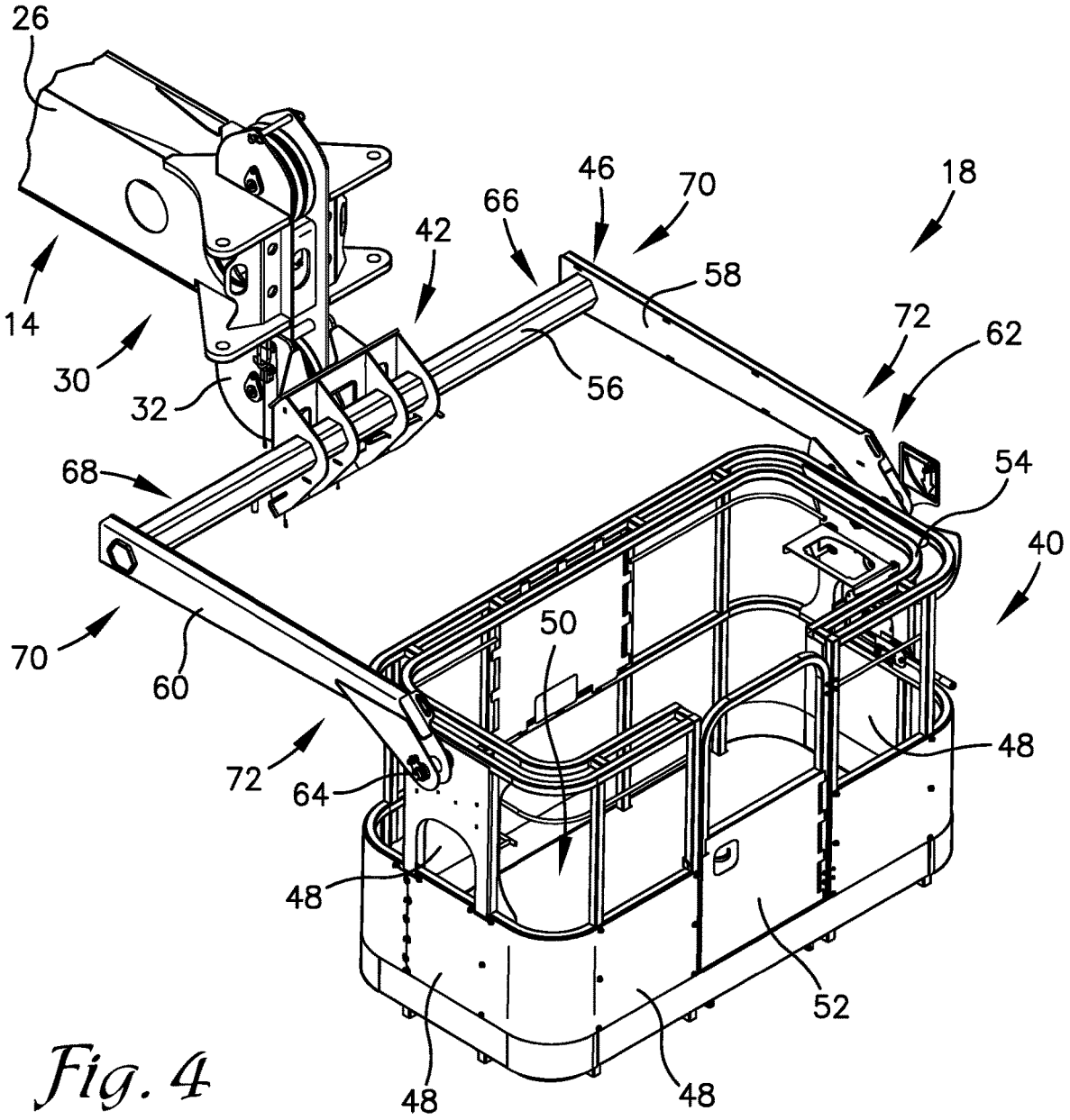
FIG. 4 is a perspective view of the utility platform assembly being secured to the boom assembly.

In embodiments of the invention as best illustrated in FIG. 4, the utility platform 44 comprises four bucket sidewalls 48 and a bucket floor that collectively form a cavity 50. The utility worker stands in the cavity 50 to perform work. The utility platform 44 may further comprise a door 52 in at least one of the bucket sidewalls 48 to allow for ingress and egress of the utility worker. The utility platform 44 may also comprise a handrail 54 for utility worker safety. The utility platform 44 may also comprise an attachment point for a lanyard worn by the utility worker.

In embodiments of the invention, the utility platform 44 remains substantially level regardless of the position of the boom assembly 14. In other embodiments, the utility worker manipulates a set of upper controls to manipulate the utility platform 44 into the flat position. The leveling may be accomplishing by pivoting the boom raise 32, pivoting the yoke 46, or both.

The four bucket sidewalls 48 of the utility platform 44 may be successively coupled to one another to form the cavity 50 with a horizontal cross-section that is substantially rectangular. Thus, two of the opposing bucket sidewalls 48 may have a greater width than the other two opposing bucket sidewalls 48. In other embodiments, the four bucket sidewalls 48 may form the cavity 50 with a horizontal cross-section that is substantially square. The bucket floor is coupled to at least one of the four bucket sidewalls 48. Although the dimensions of the platform may vary widely, an exemplary platform for one or two utility workers has a horizontal cross-section of approximately 24 inches by approximately 60 inches and has a height of approximately 42 inches.

As best illustrated in FIG. 4, embodiments of the yoke 46 comprise the adapter-receptor segment 42, a traversing segment 56, a first sidearm segment 58, a second sidearm segment 60, a first platform interface 62, and a second platform interface 64. The adapter-receptor segment 42 is secured to the traversing segment 56. The traversing segment 56 presents a first end 66 and a second end 68. The first sidearm segment 58 and the second sidearm segment 60 each presents a proximal end 70 and a distal end 72. The first sidearm segment 58 is secured at the proximal end 70 to the first end 66 of the traversing segment 56. The first sidearm segment 58 is secured at the distal end 72 to the first platform interface 62. The second sidearm segment 60 is secured at the proximal end 70 to the second end 68 of the traversing segment 56. The second sidearm segment 60 is secured at the distal end 72 to the second platform interface 64. The first and second platform interfaces 62, 64 pivot so as to ensure that the utility platform 44 remains level.

Figure 7:
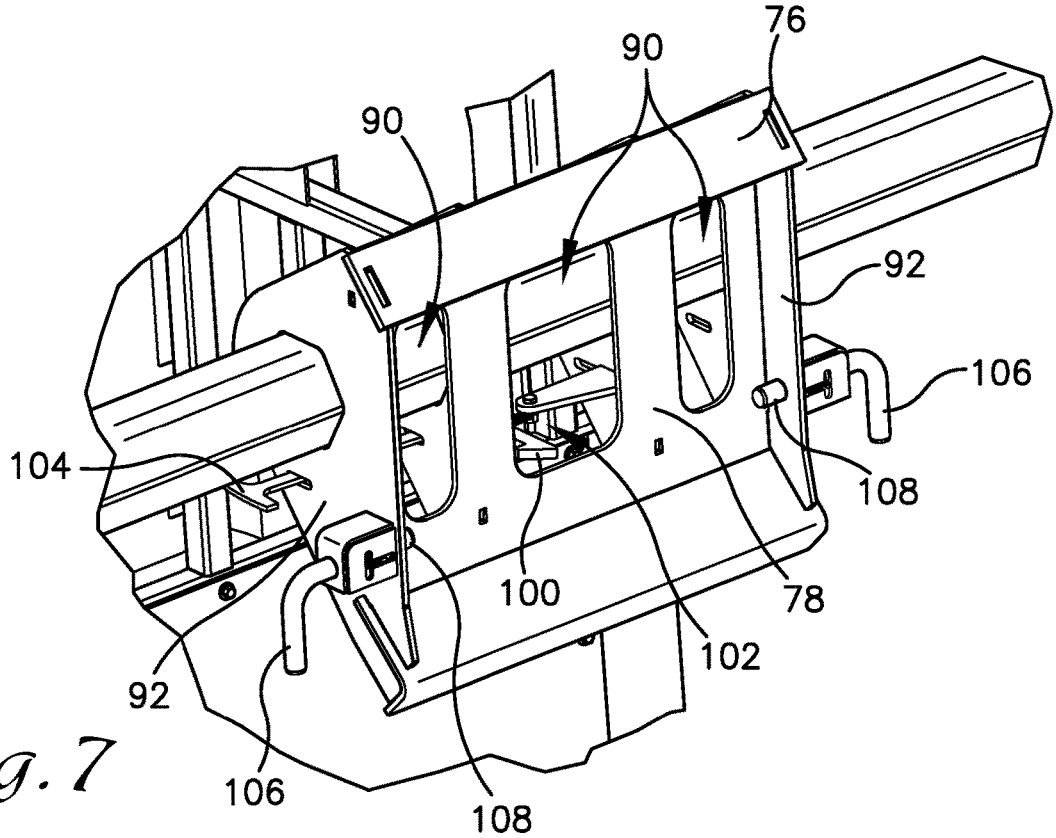
FIG. 7 is a perspective view of an adapter-receptor segment of the utility platform.
Figure 9:
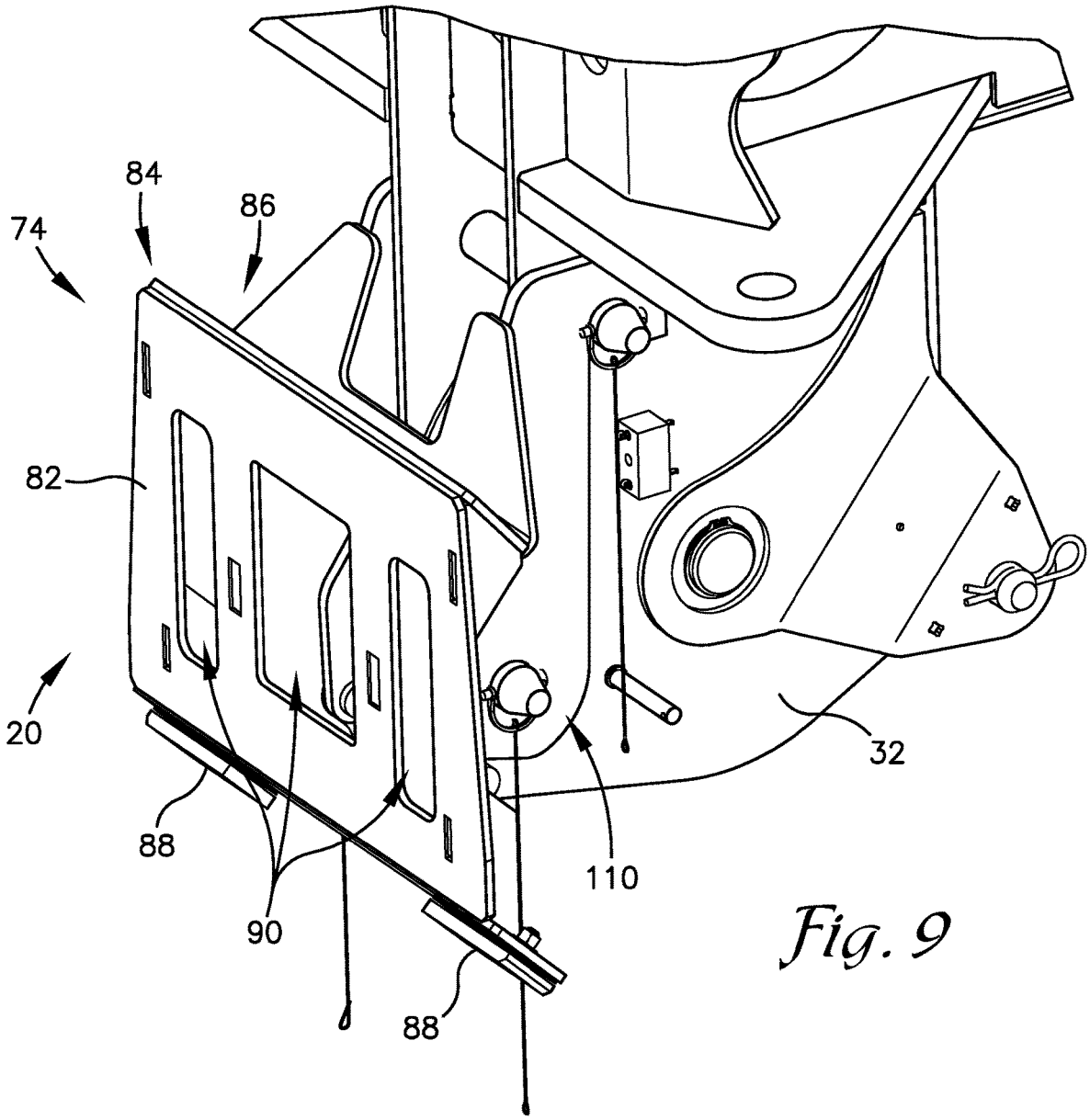
FIG. 9 is a perspective view of the adapter installed on the boom assembly.
Figure 10:
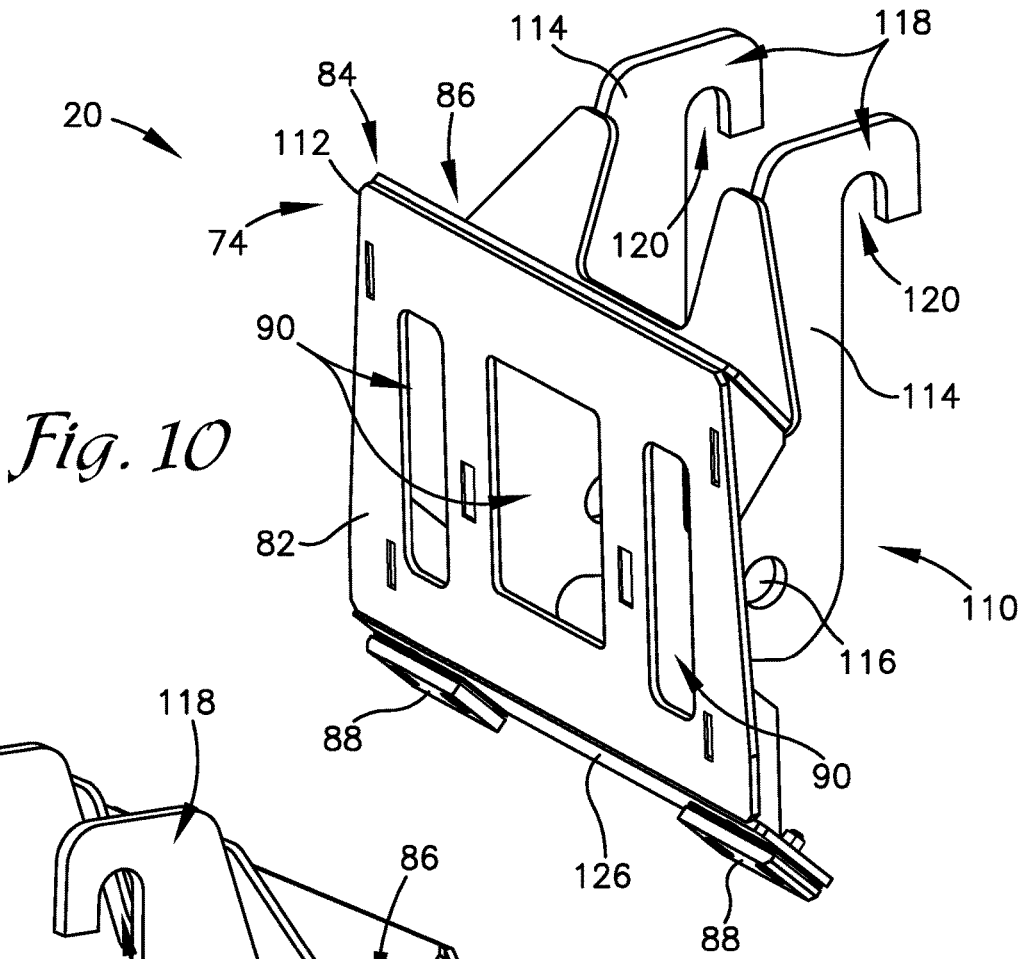
FIG. 10 is a perspective view of the adapter.

The complementary shapes of the adapter-receptor segment 42 of the implement 16 and an implement-interfacing segment 74 of the adapter 20 that allow for the quick implement will now be discussed, as best illustrated in FIGS. 7 and 9-10. It should be noted, however, that while a single exemplary complementary shape is discussed in depth, any complementary shape that allows for quick coupling is within the scope of this invention. The adapter-receptor segment 42 of the implement 16 (e.g., the yoke 46 of the utility platform assembly 18) comprises a lip segment 76, a plate 78, and at least one latch 80. The implement-interfacing segment 74 of the adapter 20 comprises a plate 82 and a wedge protrusion 84 that presents a wedge recess 86. The wedge protrusion 84 fits into the lip segment 76. The lip segment 76 covers the wedge protrusion 84 and into the wedge recess 86. As the wedge protrusion 84 and the lip segment 76 fit together, the plate 82 of the adapter 20 and the plate 78 of the implement 16 fit parallel and adjacent to each other, each being oriented in a substantially vertical direction and being of a substantially similar size and shape. As the implement 16 and adapter 20 fit together, the at least one latch 80 secures the two together. In some embodiments, the adapter 20 further comprises at least one reinforced pad 88 for supporting the weight of the implement 16. In some embodiments, the at least one latch 80 is located on the adapter 20 instead of on the implement 16.

Figure 8:
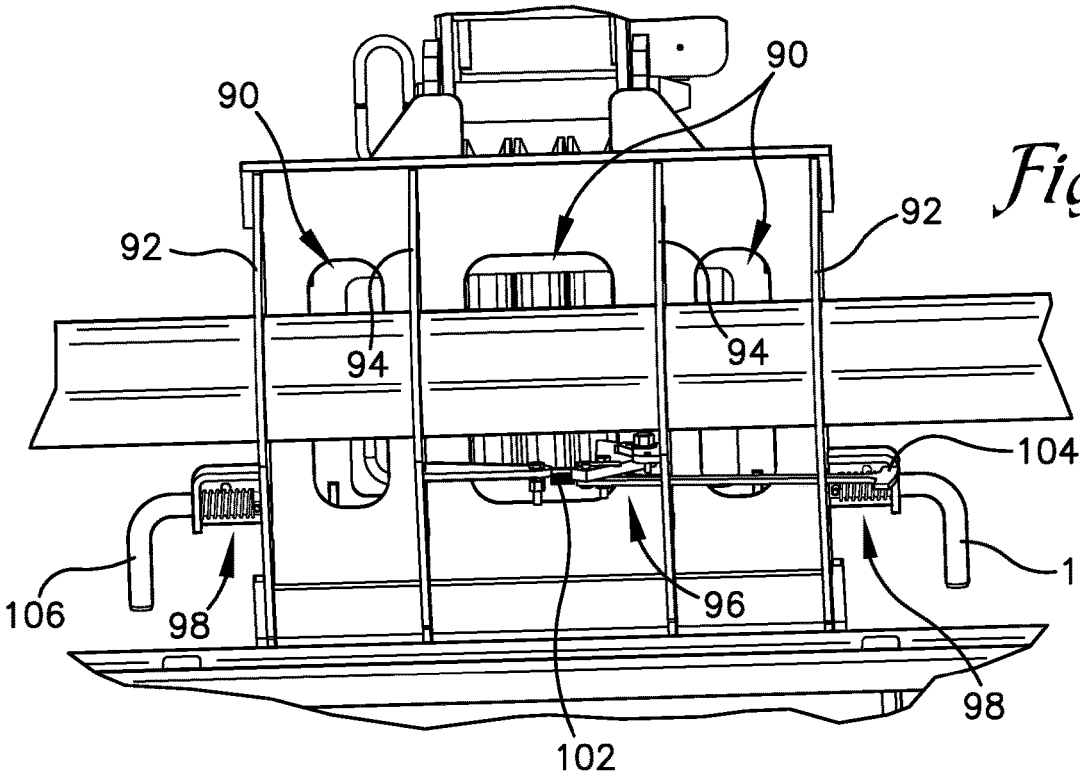
FIG. 8 is a perspective view of the adapter-receptor segment of the utility platform, as viewed from the utility platform.

Embodiments of the adapter-receptor segment 42 of the implement 16 will now be discussed in more detail. The plate 78 is secured to the traversing segment 56 of the yoke 46 of the utility platform assembly 18 (or another segment of the implement 16). As illustrated in FIG. 7, the plate 78 may have at least one opening 90 to reduce the weight, provide strength, and/or allow for the latch 80 to pass through. The adapter-receptor segment 42 may further comprise at least one sidewall 92. The sidewalls 92 provide lateral stability and prevent the adapter 20 from becoming unsecured. In addition, there may be at least one reinforcing plate 94, as illustrated in FIG. 8, to provide additional support for the weight of the implement 16 and the load.

The implement 16 is secured to the adapter 20 using the latch 80, being an automatic latch 96 and/or a manual latch 98. The automatic latch 96 operates via a retaining head 100 and an actuator 102. As illustrated in FIG. 8, the automatic latch 96 may be emplaced behind the plate 78, such that the retaining head 100 is extended through one of the openings 90 of the plate 78 of the adapter-receptor segment 42. As the plate 82 of the adapter 20 and the plate 78 of the adapter-receptor segment 42 come parallel and adjacent, the automatic latch 96 engages. As the two plates 78, 82 come together, the plate 82 of the adapter 20 slides past the retaining head 100 and compresses or otherwise activates the actuator 102. As the two plates 78, 82 become substantially parallel and adjacent, the retaining head 100 slides past the plate 82 of the adapter 20 and the actuator 102 keeps the retaining head 100 secured. The automatic latch 96 further comprises a release handle 104 coupled to or associated with the actuator 102. The utility worker (or other operator) engages the release handle 104 to release the automatic latch 96 and thereby release the implement 16 from the adapter 20. As illustrated in FIG. 7, the utility worker would pull the release handle 104 away from the sidewall 92 of the adapter-receptor segment 42 to disengage.

With the automatic latch 96 secured, the utility worker (or other operator) then activates the two manual latches 98. The manual latches 98 operate via a handle 106 and a retaining head 108. Each of the manual latches 98 may be emplaced in the sidewall 92 of the adapter-receptor segment 42. In embodiments of the invention, the manual latches 98 operate by the utility worker rotating the handles 106 from a first position corresponding to the retaining head 108 in a recessed position (not illustrated) to a second position corresponding with the retaining head 108 in an extended position (as illustrated in FIG. 7). For example, in the first position the handles 106 may be parallel to the ground, and in the second position the handles 108 may be perpendicular to the ground. The manual latches 98 may further comprise a lock to prevent inadvertent rotation of the handle 106 (and thereby inadvertent decoupling).

With all latches 80 engaged the implement 16 is secured to the adapter 20 in four ways. First, the lip segment 76 of the adapter-receptor is secured in the wedge recess 86 of the adapter 20. Second, the automatic latch 96 is securing the two plates 78, 82 together through a corresponding opening 90 in each plate. Third and Fourth, the two manual latches 98 are engaged at each sidewall 92.

While the above is an exemplary layout of the implement 16, other orientations, components, and layouts would be within the scope of the invention. For example, the adapter-receptor segment 42 could utilize four manual latches 98 and no automatic latch 96. As another example, the adapter-receptor segment 42 could utilize two automatic latches 96 and no manual latches 98. As yet another example, the manual latches 98 could be secured behind the plate 78 of the adapter-receptor segment 42, such that they extend through the opening 90 (in this example, the retaining head 108 of the manual latch 98 would have a shape that would secure when rotated, similar to the shape of the retaining head 108 of the automatic latch 96 as illustrated). As yet a further example, the automatic latches 96 could be secured on the sidewalls 92. Alternatively, or in addition, the latches 80 could be placed on the adapter 20 for securing the adapter-receptor segment 42 of the implement 16.

Embodiments of adapter 20 will now be described, as illustrated in FIGS. 9-13. The adapter 20 is a unitary piece adapted to be lifted and secured to the boom raise 32 by the utility worker. Then the utility worker manipulates the boom assembly 14 (with the adapter 20 secured at the end thereof) to interface with the implement 16. Alternatively, the utility worker may lift and emplace the implement 16 onto the adapter 20.

The adapter 20 broadly comprises the implement-interfacing segment 74 and a boom-raise-interfacing segment 110. Together, the boom-raise-interfacing segment 110 and the implement-interfacing segment form a main body 112 of the adapter 20. The boom-raise-interfacing segment 110 is adapted to be securely but removably coupled to the boom raise 32 of the boom assembly 14. This provides the advantage of allowing the utility worker to couple the adapter 20 directly to the boom raise 32 instead of the much heavier and bulkier implements. Since the adapter 20 is much lighter and easier to manipulate, securing implements 16 (such as the utility platform assembly 18) becomes much easier and more efficient using the quick-coupling features of the implement-interfacing segment 74. Similarly, securing implements 16 via the adapter 20 is quicker because the utility worker is not required to precisely align the first opening 34 and the second opening 36 of the boom raise 32 with a set of openings (not illustrated) in the implement 16, but instead has only to align the presented complementary shapes such as the wedge shapes illustrated in FIGS. 2-3.

Figure 11:
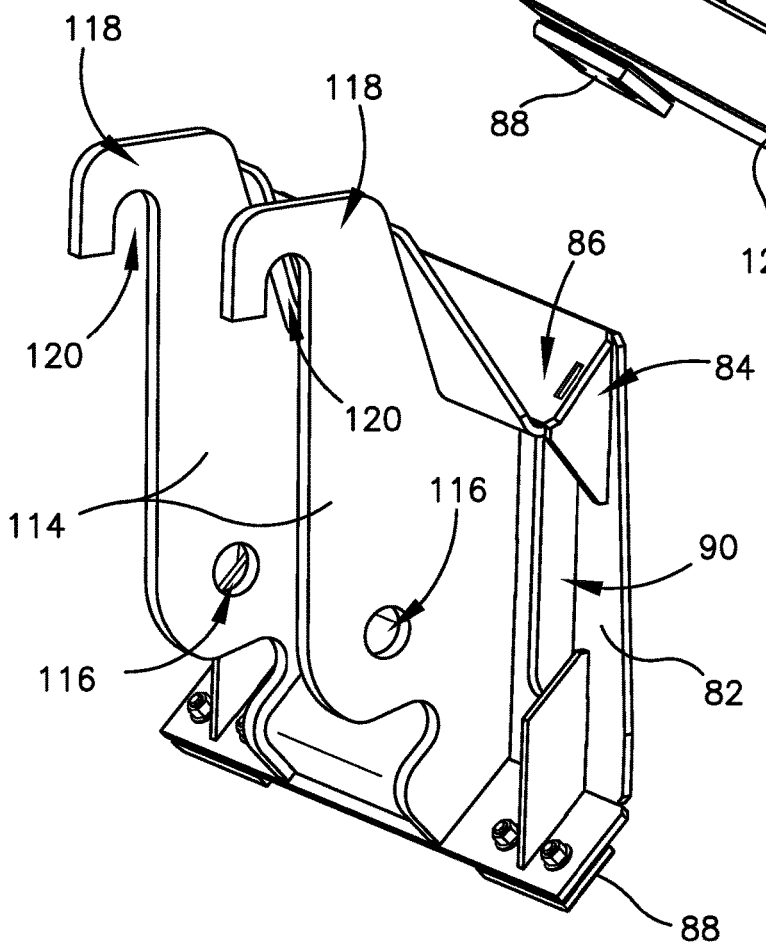
FIG. 11 is another perspective view of the adapter from FIG. 10.
Figure 12:
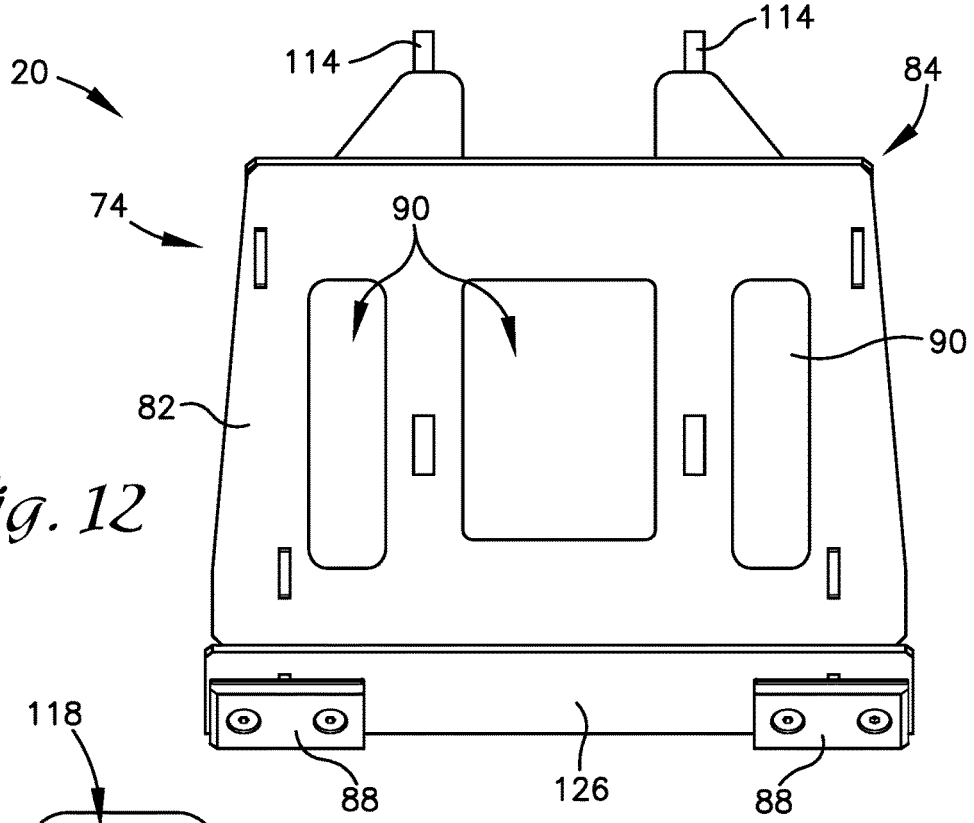
FIG. 12 is a front elevation view of the adapter from FIG. 10.
Figure 13:
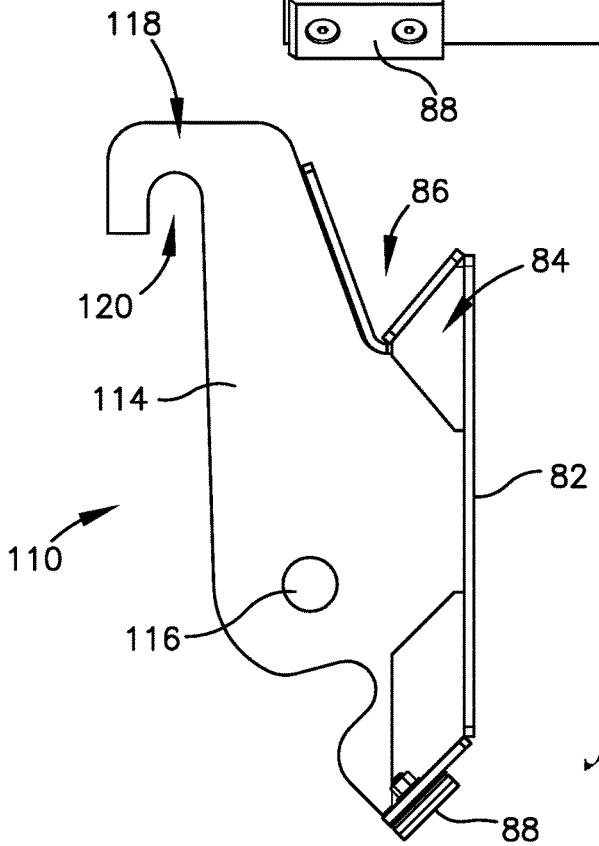
FIG. 13 is a side elevation view of the adapter from FIG. 10.

As best illustrated in FIG. 11, embodiments of the boom-raise-interfacing segment 110 comprise two vertical plates 114. Each vertical plate 114 comprises an opening 116, and a hook segment 118 that presents a recess 120. The two vertical plates 114 fit around the boom raise 32, such that the adapter 20 covers a portion of the boom raise 32 when installed. The recess 120 of the hook segment 118 is aligned with the corresponding first opening 34 of the boom raise 32. The opening 116 of the vertical plate 114 is aligned with the corresponding second opening 36 of the boom raise 32. One of the retaining pins 38 is emplaced through the recess 120 and the first opening 34. Another of the retaining pins 38 is emplaced through the opening 116 in the vertical plate 114 of the adapter 20 and the second opening 36. The retaining pins 38 comprise a head 122 and a lock 124 to ensure they remain secured once emplaced. The hook segments 118 provide the advantage of ease of installation. The utility worker can place the retaining pin 38 through the first opening 34 in the boom raise 32 that corresponds with the recess 120 of the hook segments 118. The utility worker can then easily hook the hook segments 118 over the retaining pin 38. Finally, the utility worker aligns the openings 116 of the vertical plate 114 with the second opening 36 of the boom raise 32 and emplaces the retaining pin 38. The relative locations of the two retaining pins 38 ensures that the retaining pin 38 through the first opening 34 is secured.

In other embodiments, the vertical plates 114 of the boom-raise-interfacing segment 110 each comprise two openings 116 in lieu of the hook segment 118 and recess 120 (not illustrated). In still other embodiments, the boom-raise-interfacing segment 110 of the adapter 20 is welded or otherwise permanently secured to the boom raise 32. This may be advantageous for uses in which all implements 16 comprise the quick-coupling feature. In yet other embodiments, the adapter 20 is originally manufactured as part of the boom raise 32. In these embodiments, all implements 16 would also utilize the quick-coupling feature.

The implement-interfacing segment 74 of the adapter 20, as best illustrated in FIGS. 9 and 10, comprises the plate 82, the wedge protrusion 84 presenting the wedge recess 86 and the reinforced pads 88. The plate 82 presents at least one opening 90 that is aligned to correspond with the at least one opening 90 on the plate 78 of the adapter-receptor segment 42 of the implement 16. This allows the automatic latch 96 to secure the two plates 78, 82 together. The plate forms half of the wedge protrusion 84. The wedge protrusion 84 is adapted to interface with the lip segment 76 of the adapter-receptor segment 42 and support a portion of the weight of the adapter 20. The wedge recess 86 is secured to the boom-raise-interfacing of the adapter 20. The reinforced pads 88 may be on a recessed segment 126 of the plate 82, as illustrated in FIGS. 9-10, or they may be on a non-recessed portion of the plate (not illustrated). The reinforced pads 88 provide extra support for the implement 16. The reinforced pads 88 may be bolted or welded on.

The implement-interfacing segment 74 of the adapter 20 is secured to the boom-raise-interfacing segment 110 of the adapter 20. The implement-interfacing segment 74 may be welded to the boom-raise-interfacing segment 110. The implement-interfacing segment 74 may also be monolithic with the boom-raise-interfacing segment 110. In some embodiments, the adapter 20 is formed of a metal. In other embodiments, the adapter 20 is formed of a hardened polymer, such as fiberglass. The polymer assists in electrically insulating and isolating the implement 16 from the base 12 of the aerial device 10. This can prevent the discharge of electricity from a power line or other electrical component through the aerial device 10. Similarly, the implement 16, the boom raise 32, and/or the boom assembly 14 may be formed of a hardened polymer.

A method of installing the implement 16 onto the aerial device 10 will now be discussed. The method comprises the following steps. The utility worker obtains the aerial device 10, the implement 16 having the adapter-receptor segment 42, and the adapter 20. The utility worker installs the adapter 20 on the boom raise 32 of the boom assembly 14 of the aerial device 10, utilizing at least one retaining pin 38. The utility worker manipulates the boom assembly 14 and/or the utility platform assembly 18 to align them and extends the boom assembly 14 until the wedge protrusion 84 of the adapter 20 interfaces under the lip segment 76 of the adapter-receptor segment 42. This allows the utility worker to couple the implement 16 without precisely aligning a set of openings in the implement 16 with the first opening 34 and the second opening 36 of the boom raise 32 via the boom assembly 14. The utility worker lifts the boom assembly 14 until the boom assembly 14 begins to lift the implement 16. As this happens the plate 78 of the adapter-receptor segment 42 and the plate 82 of the adapter 20 become substantially parallel and adjacent. At least one automatic latch 96 then engages to secure the implement 16 to the adapter 20. The utility worker may then additionally secure at least one manual latch 98 to further secure to two devices together. The operator then performs the desired task utilizing the implement 16. Upon completion or the need for another type of implement, the utility worker returns the implement 16 to substantially near the ground by manipulating the boom assembly 14. The utility worker then releases the implement 16 by manipulating the automatic latch 96 and/or the manual latch 98.

In some embodiments of the method, the aerial device 10, the implement 16, and the adapter 20 are obtained together. In other embodiments, the utility worker obtains the implement 16 and the adapter 20 to be utilized on an existing aerial device 10. In some embodiments of the invention, the utility worker (or other operator) permanently couples the adapter 20 to the boom raise 32 by welding or applying a high-strength adhesive. This may be desirable if the utility worker will only be utilizing implements 16 with the quick-coupling feature of the invention. In some embodiments, there may be a retroactive adapter (not illustrated) that quick-couples to the adapter 20 to return the boom raise 32 to the original configuration of openings 34, 36 to accommodate implements without an adapter-receptor segment 42. In some embodiments of the method, the utility worker may move the boom assembly 14 left, right, or down to engage the quick coupling feature (such that the complementary shape of the adapter 20 and the adapter-receptor segment 42, described above, are oriented in that direction). In some embodiments of the method, the utility worker does not manually engage any latches 80 because each is an automatic latch 96. In other embodiments, the utility worker only engages the manual latches 98 in certain situations (for example, when the implement 16 is a utility platform 44 and there are people therein, or when the implement 16 is a winch with a heavy load) as an additional safety feature.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A utility platform assembly for quickly coupling to a boom raise of a boom assembly of an aerial device, the utility platform assembly comprising:

a utility platform for supporting a utility worker;

a yoke pivotably secured to the utility platform and including a lip; and an adapter for installing on the boom raise to allow for quick coupling to the yoke, the adapter including— a boom-raise-interfacing segment for securely and removably coupling to the boom raise of the boom assembly;

a plate configured to interface with the yoke;

a V-shaped wedge protrusion formed of a front wedge plate and a rear wedge plate, wherein an acute angle is presented between the front wedge plate and the rear wedge plate, wherein the wedge protrusion is fixed to a first end of the plate of the adapter;

a recessed segment configured at an angle such that when the adapter contacts the yoke, the wedge protrusion of the adapter is forced into the lip, wherein the recessed segment is fixed to a second end of the plate of the adapter, wherein the lip of the yoke is oriented at an angle configured for receiving a portion of the wedge protrusion, wherein a latch is configured to secure the wedge protrusion to the lip so as to keep the yoke secured to the adapter.

2. The utility platform assembly of claim 1, wherein the boom-raise-interfacing segment of the adapter comprises at least one opening for receiving at least one retaining pin.

3. The utility platform assembly of claim 1, wherein the boom-raise-interfacing segment of the adapter comprises two hook segments that each present a recess for receiving at least one retaining pin.

4. The utility platform assembly of claim 1, wherein the recessed segment of the adapter comprises:

at least one reinforced pad for supporting at least a portion of the utility platform assembly.

5. The utility platform assembly of claim 1, wherein the yoke comprises:

a traversing segment secured to the yoke and presenting a first end and a second end;

a first sidearm segment secured at a proximal end to the first end of the traversing segment;

a second sidearm segment secured at a proximal end to the second end of the traversing segment;

a first platform interface pivotably secured to a distal end of the first sidearm segment; and a second platform interface pivotably secured to a distal end of the second sidearm segment.

6. The utility platform assembly of claim 1, wherein the latch is an automatic latch that operates via an actuator for securing the adapter to the yoke.

7. The utility platform assembly of claim 1, wherein the latch is a pivoting latch that operates via a handle for securing the adapter to the yoke, wherein the adapter is secured to the yoke when the handle is in a first position, wherein the adapter is unsecured from the yoke when the handle is in a second position.

8. The utility platform assembly of claim 1, wherein the latch is an automatic latch that operates via an actuator, further comprising:

two pivoting latches that each operate via a handle.

* * * * *